United States Patent [19]

Zorbaugh

[11] 3,953,000

[45] Apr. 27, 1976

[54] HOIST WITH LOAD LIMITING DEVICE

[75] Inventor: William R. Zorbaugh, York, Pa.

[73] Assignee: American Chain & Cable Company, Inc., Bridgeport, Conn.

[22] Filed: Nov. 29, 1974

[21] Appl. No.: 528,166

[52] U.S. Cl. ..... 254/169; 192/56 R
[51] Int. Cl.[2] ..... B66D 1/00
[58] Field of Search ..... 254/169, 170, 171, 175.3, 254/149, 187 C, 187 R; 192/31, 56 R, 54, 89 B, 87.1, 72

[56] References Cited

UNITED STATES PATENTS

| | | | |
|---|---|---|---|
| 2,690,825 | 10/1954 | McWethy | 192/56 R |
| 2,825,437 | 3/1958 | Reykjalin | 192/56 R |
| 3,108,670 | 10/1963 | Habicht | 192/56 R |
| 3,468,403 | 9/1969 | Nasuytis | 192/56 R |

FOREIGN PATENTS OR APPLICATIONS

| | | | |
|---|---|---|---|
| 471,163 | 7/1947 | Canada | 254/169 |

*Primary Examiner*—Robert J. Spar
*Assistant Examiner*—Kenneth Noland
*Attorney, Agent, or Firm*—Barnes, Kisselle, Raisch & Choate

[57] ABSTRACT

A hand hoist comprising a hand wheel adapted to be moved by hand. The wheel has a plurality of circular openings therein spaced circumferentially of said wheel. A plurality of friction discs are placed in the openings and have opposed surfaces. A driven member is adapted to be connected to the hoist for providing a drive for lifting. The driven member has a surface engaging one of the opposed surfaces of the discs and a pressure member engages the other of the surfaces of the discs. Spring means apply yielding pressure to the pressure member.

6 Claims, 3 Drawing Figures

HOIST WITH LOAD LIMITING DEVICE

This invention relates to hoists and particularly to hand hoists.

BACKGROUND OF THE INVENTION

A typical hand hoist comprises a planetary spur gear design and includes a handchain wheel with an endless handchain that drives a gear reduction through a Weston type mechanical load brake. The gear reduction in turn drives a load sheave or load wheel to which the load chain with hook is fitted. Pulling on one side of the endless handchain with sufficient force will raise the load hook and the load. Pulling on the opposite side of the handchain will lower the load hook.

Because competitive conditions require that hand hoists be relatively inexpensive and at the same time give long service under adverse conditions, in fact, users frequently overload hoists. The resulting wear under such conditions is excessive and a hazard to life and property.

As a hoist in many installations is available to anyone on the floor who wishes to use it and many who have only occasional need for it are ignorant or indifferent to the limitations of its use, it would seem desirable to arrange a hand hoist so that it cannot be abused by overloads engendered by attempts to lift large weights or by various faulty practices which produce excessive and unsafe stresses on the hand hoist.

The desirability of a load limiting device has long been recognized in connection with the hand hoist.

It is an object of the present invention to provide a hand hoist which will not lift any load beyond a predetermined maximum load; and wherein overloading of the hand hoist does not interfere with the normal operation of the hand hoist.

DESCRIPTION

Figure 2:
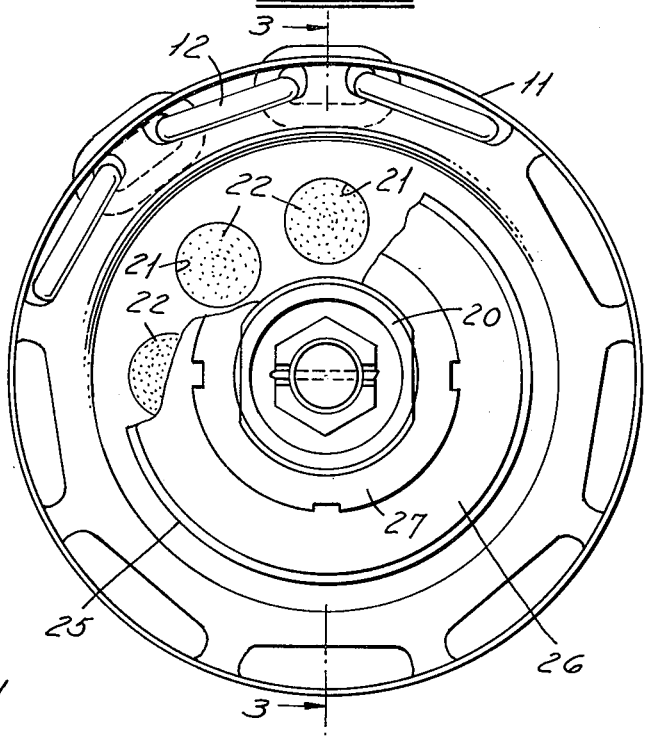
FIG. 2 is a side elevational view, parts being braken away.
Figure 3:
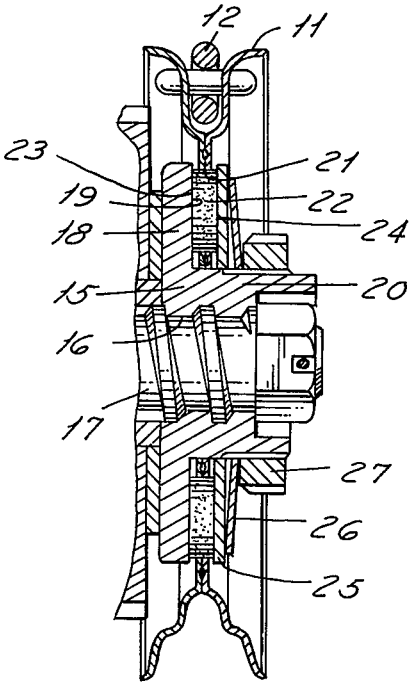
FIG. 3 is a sectional view taken along the line 3—3 in FIG. 2.
Figure 1:
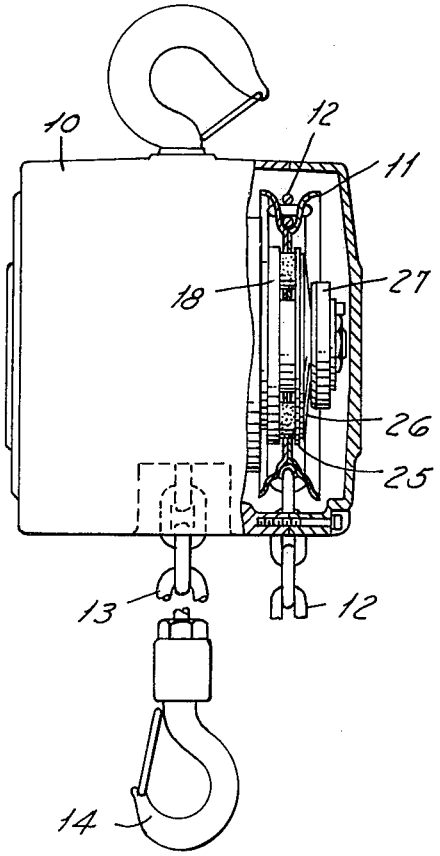
FIG. 1 is a part sectional view of a part of a hand hoist embodying the invention.

Referring to the drawings, the invention is applicable to hoists and particularly to hand hoists such as those which use a Weston type mechanical load brake.

Referring to the drawings, a typical hand hoist line comprises a housing 10 enclosing a planetary spur gear design (not shown) and includes a handchain wheel 11 with an endless handchain 12 that drives a gear reduction through a Weston type mechanical load brake (not shown). The gear reduction in turn drives a load sheave or load wheel to which the load chain 13 with hook 14 is fitted. Pulling on one side of the endless handchain 12 with sufficient force will raise the load hook and the load. Pulling on the opposite side of the handchain 12 will lower the load hook. The load limit structure of the present invention is applied between the handchain wheel 11 and the Weston type mechanical load brake and will slip if the pull on the handchain exceeds a predetermined setting for the capacity of the hoist.

In accordance with the invention, the load limiting device includes a driven member 15 formed with a thread 16 for engaging the spindle 17 of the drive shaft of the hoist that extends to the gearing for lifting the load. The driven member 15 includes an annular flange 18 having flat annular surface 19 extending radially.

Further, in accordance with the invention, hand wheel 11 is provided on the extension 20 of the driven member and has a plurality of circumferentially spaced circular openings 21 therein. Friction discs 22 are provided in the circular openings 21 and have opposed flat surfaces 23,24, one surface 23 engaging the annular surface 19 of the driven member 15. A pressure member 25 in the form of an annular disc is provided and engages the opposite surface 24 of the discs 22. A Belleville spring 26 engages the pressure member 25 and is urged toward the pressure member 25 by a nut 27 threaded on the extension 20 of the driven member.

In operation, when the hoist is overloaded, the discs will start to rotate independently of one another about the axis of openings 21 and result in a smooth breakway or slipping of the hand wheel. Utilization of such a construction will not allow the load to be jerk lifted.

It has been found that a hoist made in accordance with the invention forces the user to handle the hoist and load with needed care.

The invention can be readily adapted as a modification to existing hoists.

Although the invention has been described and is particularly useful with hand hoists, it it also has utility on power hoists such as a conventional power chain driven sprocket type hoist.

I claim:

1. In a hand hoist, the combination comprising
a hand wheel adapted to be moved by hand,
said wheel having a plurality of circular openings therein spaced circumferentially of said wheel,
a plurality of friction discs positioned in said openings and having opposed surfaces,
said discs being independently rotatable in said openings about the axis of said openings,
a driven member adapted to be connected to the hoist for providing a drive for lifting,
said driven member having a surface engaging one of said opposed surfaces of said discs,
a pressure member engaging the other of said surfaces of said discs,
and means yieldingly urging said pressure member toward said discs.

2. The combination set forth in claim 1 wherein said last-mentioned means includes a Belleville spring.

3. The combination set forth in claim 2 including a nut threaded on said driven member and engaging said Belleville spring to urge said washer against said pressure member.

4. In a hand hoist, the combination comprising
a hand wheel adapted to be moved by hand,
said wheel having a plurality of circular openings therein spaced circumferentially of said wheel,
a plurality of circular friction discs positioned in said openings and having opposed flat surfaces,
said discs being independently rotatable in said openings about the axis of said openings,
a driven member adapted to be connected to the hoist for providing a drive for lifting,
said driven member having a flat annular surface engaging one of said opposed surfaces of said discs,
a pressure member having a flat annular radially extending surface engaging the other of said surfaces of said discs, and spring means for applying a yielding pressure to said pressure member.

5. The combination set forth in claim 4 wherein said spring means includes a Belleville spring.

6. The combination set forth in claim 5 including a nut threaded on said driven member and engaging said Belleville spring to urge said washer against said pressure member.

* * * * *